US007560159B2

(12) United States Patent
Goda et al.

(10) Patent No.: US 7,560,159 B2
(45) Date of Patent: Jul. 14, 2009

(54) SYNTHETIC STAPLE FIBERS FOR AN AIR-LAID NONWOVEN FABRIC

(75) Inventors: Hironori Goda, Matsuyama (JP); Nobuyuki Yamamoto, Matsuyama (JP)

(73) Assignee: Teijin Fibers Limited, Osaka (JP)

( * ) Notice: Subject to any disclaimer, the term of this patent is extended or adjusted under 35 U.S.C. 154(b) by 569 days.

(21) Appl. No.: 10/584,468

(22) PCT Filed: Feb. 23, 2005

(86) PCT No.: PCT/JP2005/003541

§ 371 (c)(1),
(2), (4) Date: Jun. 22, 2006

(87) PCT Pub. No.: WO2005/080658

PCT Pub. Date: Sep. 1, 2005

(65) Prior Publication Data

US 2009/0053521 A1 Feb. 26, 2009

(30) Foreign Application Priority Data

Feb. 23, 2004 (JP) ..... 2004-045804

(51) Int. Cl.
*D02G 3/00* (2006.01)

(52) U.S. Cl. ..... 428/397; 428/400

(58) Field of Classification Search ..... 428/397, 428/400

See application file for complete search history.

(56) References Cited

U.S. PATENT DOCUMENTS 5,108,838 A * 4/1992 Tung ..... 428/357
5,208,106 A * 5/1993 Tung ..... 428/397
5,387,469 A * 2/1995 Warren ..... 428/397
5,677,059 A * 10/1997 Kakita et al. ..... 428/397
5,707,737 A * 1/1998 Mori et al. ..... 428/397
5,733,656 A * 3/1998 Iohara et al. ..... 428/397
5,879,801 A * 3/1999 Helms et al. ..... 428/373
5,904,982 A * 5/1999 Kent et al. ..... 428/376
5,922,462 A * 7/1999 Kent et al. ..... 428/373
5,948,528 A * 9/1999 Helms et al. ..... 428/373
6,093,491 A * 7/2000 Dugan et al. ..... 428/397
6,296,933 B1 * 10/2001 Goda et al. ..... 428/364
6,610,403 B1 * 8/2003 Kasabo et al. ..... 428/397
6,660,377 B2 * 12/2003 Bernaschek ..... 428/357
6,673,450 B2 * 1/2004 Boyle et al. ..... 428/397
6,841,247 B2 * 1/2005 Blackwell et al. ..... 428/397
6,958,188 B2 * 10/2005 Blackwell et al. ..... 428/397
7,387,976 B2 * 6/2008 Baba et al. ..... 442/268

FOREIGN PATENT DOCUMENTS

JP 2-234914 A 9/1990
JP 8-246225 A 12/1996
JP 11-81116 A 3/1999
JP 2000-282323 A 10/2000
WO WO 97/48846 A1 12/1997

* cited by examiner

*Primary Examiner*—N. Edwards
(74) *Attorney, Agent, or Firm*—Sughrue Mion, PLLC

(57) ABSTRACT

Synthetic staple fibers having good air opening property and useful for producing an air-laid nonwoven fabric having excellent quality, have a fiber length of 0.1 to 45 mm and a cross-sectional profile having 1 to 30 concavities, in which cross-sectional profile the ratio D/L, of a largest depth D of each concavity to a largest width L of the opening of the concavity, is in the range of from 0.1 to 0.5.

7 Claims, 3 Drawing Sheets

SYNTHETIC STAPLE FIBERS FOR AN AIR-LAID NONWOVEN FABRIC

TECHNICAL FIELD

The present invention relates to synthetic staple fibers for an air-laid nonwoven fabric. More particularly, the present invention relates to synthetic staple fibers for an air-laid nonwoven fabric which exhibit a good air opening property and are appropriate to produce an air-laid nonwoven fabric having excellent quality.

BACKGROUND ART

Currently, nonwoven fabrics have been widely used in fields of daily commodities, sanitary materials and medical treatment materials. Moreover, in recent years, a research on, and a development of, an air-laid nonwoven fabric capable of being produced at a high speed, and having excellent bulkiness, air-permeability and liquid permeability have advanced. Many proposals have been made for such air-laid nonwoven fabrics in which staple fibers consisting of a synthetic resin, for example, a polyolefin resin and a polyester resin and having excellent handing property and mechanical properties are used (e.g., Patent Reference 1, and the like).

A high air opening property is important to the staple fibers for the air-laid nonwoven fabric, and thus the quality of the resultant air-laid nonwoven fabric is controlled by the opening property of the staple fibers. For example, according to the investigation performed by the inventors of the present invention, the staple fibers for an air-laid nonwoven fabric having sheath layers formed from a high density polyethylene and located at the peripheral surfaces of the staple fibers, for example, poly(ethylene terephthalate)/high density polyethylene core-in-sheath type composite fibers and polypropylene/high density polyethylene core-in-sheath type composite fibers as described in Patent Reference 2 exhibit an improved high air opening property. In the air laid web formed from the above-mentioned conjugate staple fibers, the contents of unopened fiber bundles, in each of which several tens of staple fibers are arranged in parallel with each other, pill-like defects formed by entanglement of staple fibers are low and thus the resultant nonwoven fabric has an improved web quality compared with conventional fabrics.

However, even when the staple fibers as disclosed in the Patent Reference 1, and the conjugate fibers as disclosed in Patent Reference 2, namely conjugate fibers having high density polyethylene sheath components, are employed, the resultant nonwoven fabric is unsatisfactory in quality, because the water content, the individual fiber thickness and crimping condition of the staple fibers or the conjugate staple fibers influences on generation of defects on the resultant nonwoven fabric, and the generation of the defects has not yet been sufficiently controlled.

Patent Reference 1: WO 97/48846

Patent Reference 2: Japanese Unexamined Patent Publication (Kokai) No. 11-81116

DISCLOSURE OF THE INVENTION (Problems to be Solved by the Invention)

An object of the present invention is to provide synthetic staple fibers for an air-laid nonwoven fabric, having good air opening property and enabling a nonwoven fabric having excellent quality to be produced, without specifically limiting the type of the synthetic polymers for forming the fibers, the individual fiber thickness, the crimping conditions and the water content.

(Means for Solving the Problems)

In order to solve the above problems, the inventors of the present invention have intensively carried out investigations, while they have paid attention to the cross-sectional profile of staple fibers. As a result, the inventors of the present invention have found that some types of staple fibers having specific cross-sectional profiles are hardly influenced by the water content of the fibers, have a good air opening property and enable an air-laid nonwoven fabric having an excellent quality to be produced. The present invention was completed on the basis of the finding. The inventors of the present invention have further continued the investigation, and found that the air opening property of the staple fibers is affected by the thickness of the fibers, the number of crimp of the fibers and the type of the polymeric material from which the fibers are formed.

In this connection, it has been further found that the above-mentioned various problems can be simultaneously solved by appropriately establish the cross-sectional profile of the staple fibers.

The synthetic staple fibers, of the present invention, for an air-laid nonwoven fabric, which staple fibers have a fiber length of 0.1 to 45 mm and a cross-sectional profile having 1 to 30 concavities each satisfies the requirement; D/L=0.1 to 0.5, wherein D represents a largest distance between a tangent line drawn to a pair of convexities from which an opening of the concavity is defined, and a bottom of the concavity, measured in a direction at right angles to the tangent line, and L represents a distance between two points of contact of the pair of convexities with the tangent line.

The synthetic staple fibers of the present invention, for an air-laid nonwoven fabric, preferably have a water content of 0.6% by mass or more but not more than 10% by mass.

The synthetic staple fibers of the present invention, for an air-laid nonwoven fabric, preferably have a thickness of 5 dtex or less.

The synthetic staple fibers of the present invention, for an air-laid nonwoven fabric, preferably have a number of crimps of 0 to 5 crimps/25 mm or 15 to 40 crimps/25 mm.

In the synthetic staple fibers, of the present invention, for an air-laid nonwoven fabric, preferably, in each of the staple fibers, at least a portion of the peripheral surface of the staple fiber is formed from at least one member selected from the group consisting of polyester resins, polyamide resins, polypropylene resins, high pressure method low density polyethylene resins, linear low density polyethylene resins and elastomer resins.

The synthetic staple fiber, of the present invention, for an air-laid nonwoven fabric optionally further comprises at least one functional agent adhered to the surface of the staple fiber, in an amount of 0.01 to 10% by mass on the basis of the mass of the staple fiber.

In the synthetic staple fiber of the present invention for an air-laid nonwoven fabric, the functional agent is selected from the group consisting of deodorant functional agents, antibacterial functional agents, flame retardant functional agents and insect-repellent functional agents.

(Effect of Invention)

An air-laid nonwoven fabric having few defects and being excellent in quality can be obtained using the synthetic staple fibers of the present invention even with a high water content at which conventional staple fibers are difficult to open. Moreover, according to the present invention, even at small thickness, a high number of crimps or a low number of crimps (including no crimp), or, even in the presence of a resin or functional agent having a high friction value and coated on the surfaces of the staple fibers, the resultant synthetic staple fibers can be easily opened and converted to a nonwoven fabric having a high quality.

BEST MODE FOR CARRYING OUT THE INVENTION

The synthetic staple fibers, of the present invention, for an air-laid nonwoven fabric have a fiber length of 0.1 to 45 mm and a cross-sectional profile, at right angles to the longitudinal axis of the fiber, having 1 to 30 concavities each, satisfies the requirement:

$$D/L = 0.1 \text{ to } 0.5$$

wherein D represents a largest depth of the concavity, namely a largest distance between a tangent line drawn to a pair of convexities from which an opening of the concavity is defined, and a bottom of the concavity, measured in a direction at right angles to the tangent line, and L represents a largest opening distance, namely a distance between two points of contact of the pair of convexities with the tangent line.

Figure 1:
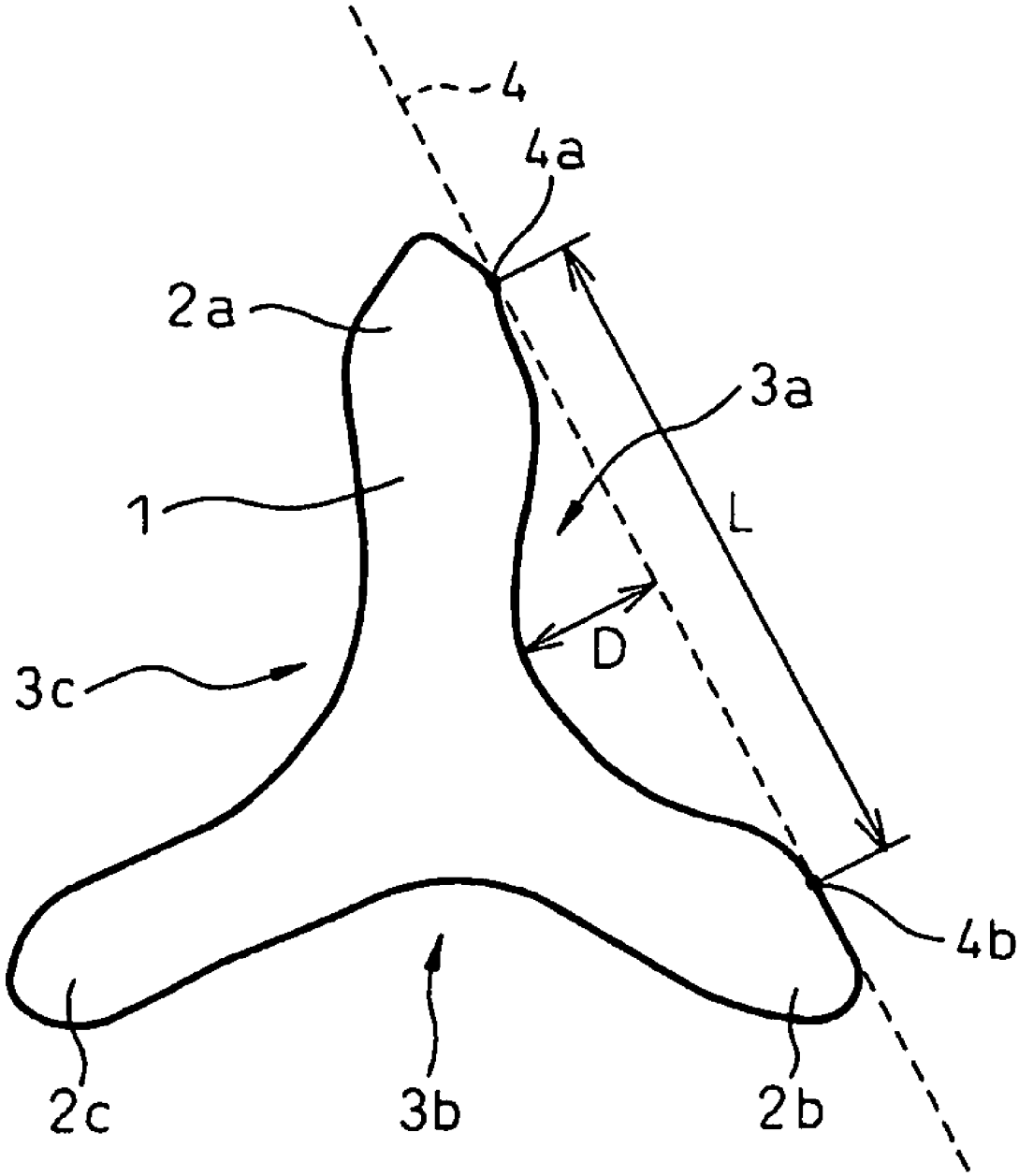
FIG. 1 show an explanatory cross-sectional profile of an embodiment of the staple fibers of the present invention, FIGS. 2-(*a*), (*b*) and (*c*) respectively show explanatory views of melt-spinning holes for non-composite fibers, FIGS. 2-(A), (B) and (C) respectively show explanatory cross-sectional view of the non-composite fibers produced by using the melt-spinning holes shown in FIGS. 2-(*a*), (*b*) and (*c*), FIGS. 3-(*d*), (*e*), (*f*) and (*g*) respectively show explanatory view of melt-spinning holes for core-in-sheath type composite fibers, and FIGS. 3-(D), (E), (F) and (G) respectively show explanatory cross-sectional view of a core-in-sheath type composite fibers produced by using the melt-spinning holes as shown in FIGS. 3-(*d*), (*e*), (*f*) and (*g*).

FIG. 1 is an explanatory view of a cross-sectional profile of an embodiment of the staple fibers of the present invention.

In FIG. 1, a staple fiber 1 has three lobar convexities 2*a*, 2*b* and 2*c* and three concavities 3*a*, 3*b*, and 3*c* formed between the convexities. One concavity, for example, the concavity 3*a* has a largest opening distance L which is represented by a distance between contacts 4*a* and 4*b* of a tangent line 4 drawn to contours of two convexities 2*a* and 2*b* by which the two end portions of the opening of the concavity 3*a* are defined, with the contours of the two convexities 2*a* and 2*b*. Also, the largest depth D of the concavity 3*a* represent a largest distance between the tangent line 4 and the contours of the concavity 3*a*. The L and D values of other concavities 3*b* and 3*c* can be determined in the same manner as mentioned above.

In the cross-sectional profile of the synthetic staple fibers of the present invention, the D/L ratios of all the concavities must be in the range of from 0.1 to 0.5.

In the staple fibers of the present invention, if the fiber length is less than 0.1 mm, the resultant nonwoven fabric exhibits an insufficient mechanical strength, or the resultant staple fibers are agglomerated to form fiber masses which are difficult to open. Also, if the fiber length of the staple fibers of the present invention is more than 45 mm, the resultant staple fibers exhibit an insufficient opening property. Preferably, the fiber length of the staple fibers of the present invention is in the range of from 1 to 45 mm, more preferably from 3 to 40 mm.

Further, in the cross-sectional profile of the staple fibers of the present invention, the ratio D/L value is less than 0.1, the open spaces formed between the staple fibers in the resultant nonwoven fabric decrease to cause the fibers located adjacent to each other to be approximately brought into close contact with each other and thus a function of trapping water from the fibers decrease, and the resultant staple fibers exhibit an insufficient air opening property.

Accordingly, in this case, the desired air-laid nonwoven fabric having a high quality cannot be obtained. Also, if the ratio D/L value is more than 0.5, sometimes, a convexity of a staple fiber fits in a concavity of another staple fiber located adjacent to the staple fiber and thus the air opening property of the staple fibers decreases. Preferably the D/L ratio value is in the range of from 0.15 to 0.35, more preferably from 0.20 to 0.30.

In the cross-sectional profile of the staple fibers of the present invention, when the number of the concavities is 1 or more per fiber, the above-mentioned effects can be attained, and the larger the number of the concavities, the better the air opening property of the resultant staple fibers. However, if the number of the concavities is more than 30 per fiber, the D/L ratio value is difficult to control within the above-mentioned range. Preferably, the number of the concavities is 2 to 20 per fiber, more preferably 3 to 10 per fiber.

In the case of the conventional staple fibers, an increase in water content of the fibers to 0.6% by mass or more, causes the air opening property of the resultant staple fibers to decrease, and thus the resultant nonwoven fabric exhibit a degraded quality. Compared with this, in the case of the staple fibers of the present invention, the air opening property is good even when the water content is high. The reason for the above-mentioned performance of the staple fibers of the present invention is assumed to be that the water, which usually promotes the agglomeration of the staple fibers with each other, is trapped in the concavities formed in the peripheries of the staple fibers and thus the amount of water which promotes the agglomeration of the staple fibers decreases. If the water content is too high, the air opening property of the staple fibers even in the case where the staple fibers are those of the present invention, decreases and becomes insufficient. Thus, the water content of the staple fibers of the present invention may be 0.6% by mass or more but preferably not more than 10% by mass, more preferably not more than 3% by mass.

Also, the inventors of the present invention have found that, not only in the case where the water content is high as mentioned above, but also in the case where the thickness of the fibers is small, the number of crimps is high, the number of crimps is low or the number of crimps is zero, or the fiber surface is coated with a resin or a functional agent having a high frictional property, the resultant synthetic staple fibers of the present invention exhibit a good air opening property, and thus an air-laid nonwoven fabric having a high quality can be produced from the staple fibers of the present invention.

The conventional staple fibers having a thickness of 5 dtex or less, particularly 2.5 dtex or less, are difficult to open by the air opening method, and thus an air-laid nonwoven fabric having a high quality is difficult to obtain. Compared with this, the staple fibers of the present invention have appropriate concavities formed on the peripheries of the fibers, to cause sufficient spaces to be formed between staple fibers adjacent to each other. Therefore, even when the staple fibers are densely massed, an air flow can easily penetrate into the gaps between the staple fibers to sufficiently open the staple fibers, and thus an air-laid nonwoven fabric having a high quality can be obtained. However, even in the case of the staple fibers of the present invention, there is a tendency that, if the thickness of the staple fiber is too low, the air opening property of the staple fibers becomes insufficient. Therefore, the thickness of the staple fibers of the present invention is preferably in the range of from 0.1 to 5 dtex, more preferably from 0.1 to 2 dtex.

When the conventional staple fibers are opened, there is a problem that the low number of crimps on the staple fibers in the range of from 0 to 5 crimps/25 mm including no crimp, cause non-opened fiber bundles to be formed with a high frequency, and a high number of crimps on the staple fibers in the range of from 15 crimps/25 mm or more causes the staple fibers to be entwined with each other during the air opening procedure to form fiber pills. Compared with this, the staple fibers of the present invention have an improved air opening property for the reasons as mentioned above and, thus, the generation of the non-opened fiber bundles and the fiber pills can be reduced and an air-laid nonwoven fabric having excellent quality can be produced from the staple fibers. Accordingly, when the staple fiber of the present invention having a crimp number selected from low crimp number range is used, a non-bulky, smooth and flat nonwoven fabric can be obtained, and when the staple fibers of the present invention having a crimp number selected from high crimp number range are used, a bulky nonwoven fabric having a high porosity can be obtained. In every case, the resultant nonwoven fabric has a very low non-opened fiber bundle and fiber pill defect number, and excellent quality. In any case, as mentioned above, if the crimp number is too large, the generation of the pills is promoted, in the high crimp number range, the number of crimps is preferably in the range of from 15 to 40 crimps/25 mm, more preferably from 15 to 30 crimps/25 mm. The above-mentioned crimps may be two-dimensional crimps in the zig-zag form, or cubic crimps in a spiral or omega (Ω) form.

The staple fibers of the present invention may comprise only one type of resin or may be a composite fibers comprising two or more sections formed from two or more types of resins and combined into a fiber form, or a polymer blend fibers formed from a blend of two or more types of resins. Preferably, in the staple fiber of the present invention, at least a portion of a surface of the fiber is formed from at least one member selected from polyester resins, polyamide resins, polypropylene resins, high-pressure-method low-density polyethylene resins, linear low-density polyethylene resins and elastomer resins. In this type of staple fiber, of the present invention, the effects of the present invention is particularly exhibited. Namely, the conventional staple fibers formed from the above-mentioned types of resins have a high frictional property between fibers and thus cannot exhibit a sufficient opening property. Compared with this, in the staple fibers of the present invention, the specific cross-sectional profile of the fibers enables the contact area of the staple fibers with each other to be small and, thus, the friction of the staple fibers with each other during the air opening procedure to be reduced, the air opening property of the staple fibers to be enhanced, and a high quality air-laid nonwoven fabric to be produced.

The staple fibers of the present invention in which the above-mentioned synthetic resin is located in the fiber surfaces include single phase fibers formed from a member of the above-mentioned resins, polymer blend fibers formed from a polymer blend in which a member of the above-mentioned resins is melt, mixed in an amount of 50% or more by mass based on the mass of the fibers, with an other resin, core-in-sheath or eccentric core-in-sheath type composite fibers in which a member of the above-mentioned resins is contained as a sheath component, islands-in-sea type composite fibers in which a member of the above-mentioned resins is contained as a sea component, and side-by-side type, multi-layered type and segment pie type composite fibers in which a member of the above-mentioned resins is located in the surfaces of the fibers.

The polyester resins usable for forming the staple fibers of the present invention include (1) aromatic polyesters, for example, polyethylene terephthalate, polytrimethylene terephthalate, polybutylene terephthalate, polyhexamethylene terephthalate and polyethylene naphthalate; (2) polymers and copolymers comprising poly(α-hydroxycarboxylic acid), for example, polyglycolic acid or polylactic acid; (3) poly(ω-hydroxyalkanoate)s selected from poly(ϵ-caprolactone) and poly(β-propiolactone); (4) poly(β-hydroxyalkanoate)s selected from poly-3-hydroxypropionate, poly-3-hydroxybutyrate, poly-3-hydroxycaproate), poly-3-hydroxyheptanoate, poly-3-hydroxyoctanoate, and copolymers of the above-mentioned polymers with poly-3-hydroxyvalerate or poly-4-hydroxybutylate; (5) aliphatic polyesters selected from polyethylene oxalate, polyethylene succinate, polyethylene adipate, polyethylene azelate, polybutylene adipate, polybutylene sebacate, polyhexamethylene sebacate, polyneopentyl oxalate and copolymers of the above-mentioned polymeric compounds; and copolymers of the above-mentioned polymers (1), (2), (4) and (5) with an acid component comprising at least one member selected from, for example, isophthalic acid, succinic acid, adipic acid, sebacic acid, azelaic acid, 2,6-naphthalene dicarboxylic acid and metal sulfoisophthalic acids, for example, 5-sodium sulfoisophthalic acid, and/or a glycol component comprising at least one member selected from ethylene glycol, diethylene glycol, 1,3-trimethyleneglycol, 1,4-butanediol, 1,6-hexanediol, cyclohexanediol, cyclohexanedimethanol, polyethyleneglycol, polytrimethyleneglycol and polytetramethyleneglycol.

The elastomer resins usable for the staple fibers of the present invention include thermoplastic elastomers, for example, polyurethane elastomers, polyolefin elastomers, polyester elastomers.

The polypropylene resins usable for the staple fibers of the present invention include polypropylene homomolymers and crystalline copolymers of a major component comprising propylene with a minor component comprising ethylene or an α-olefin, for example, butene-1, hexene-1, octene-1, or 4-methylpentene-1.

The polyamide resins usable for the staple fibers of the present invention include nylon 6, nylon 66 or nylon 12.

The other resins usable for the staple fibers of the present invention include, for example, high density polyethylene, medium density polyethylene, high pressure-processed low density polyethylene, linear low density polyethylene, and fluorine-containing resins.

The above-mentioned fiber-forming synthetic resins optionally contain various additives, for example, delustering agents, heat stabilizers, anti-foam agents, tinting agents, flame retardants, antioxidants, ultraviolet ray-absorbers, fluorescent brightening agents and coloring pigments.

The staple fibers of the present invention can be produced by, for example, the following procedures.

Figure 2:
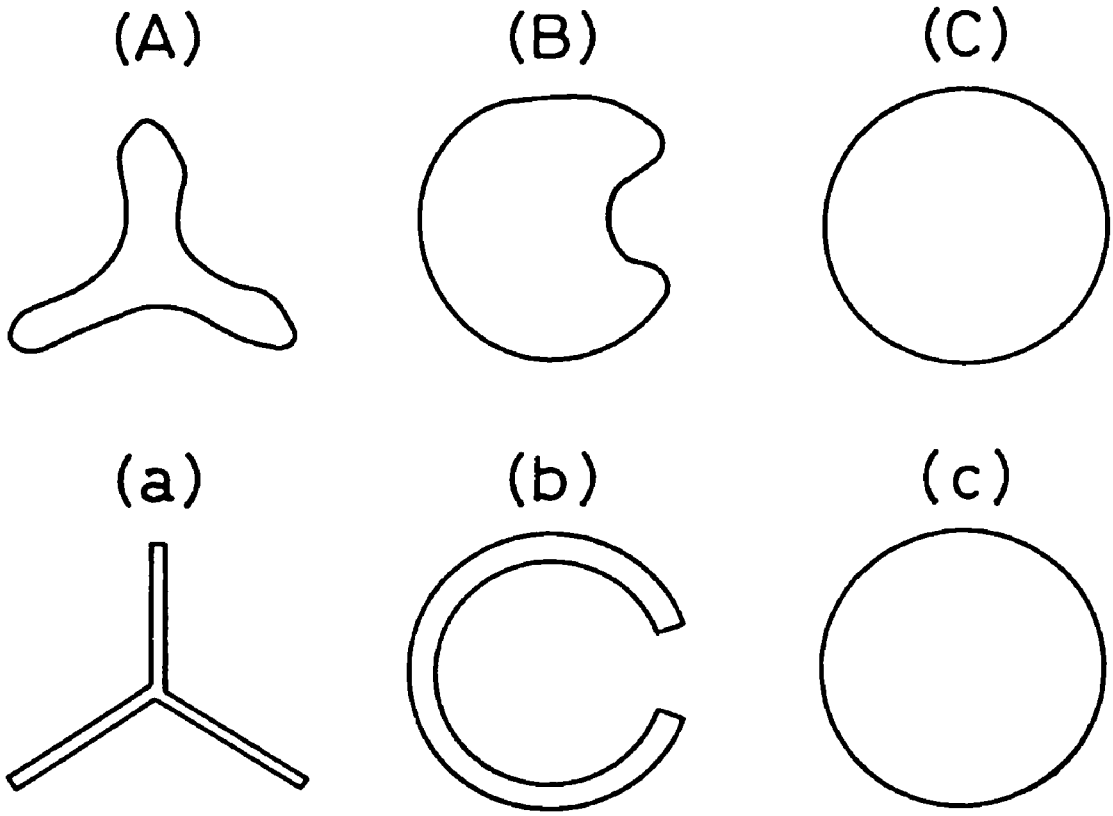
Figure 3:
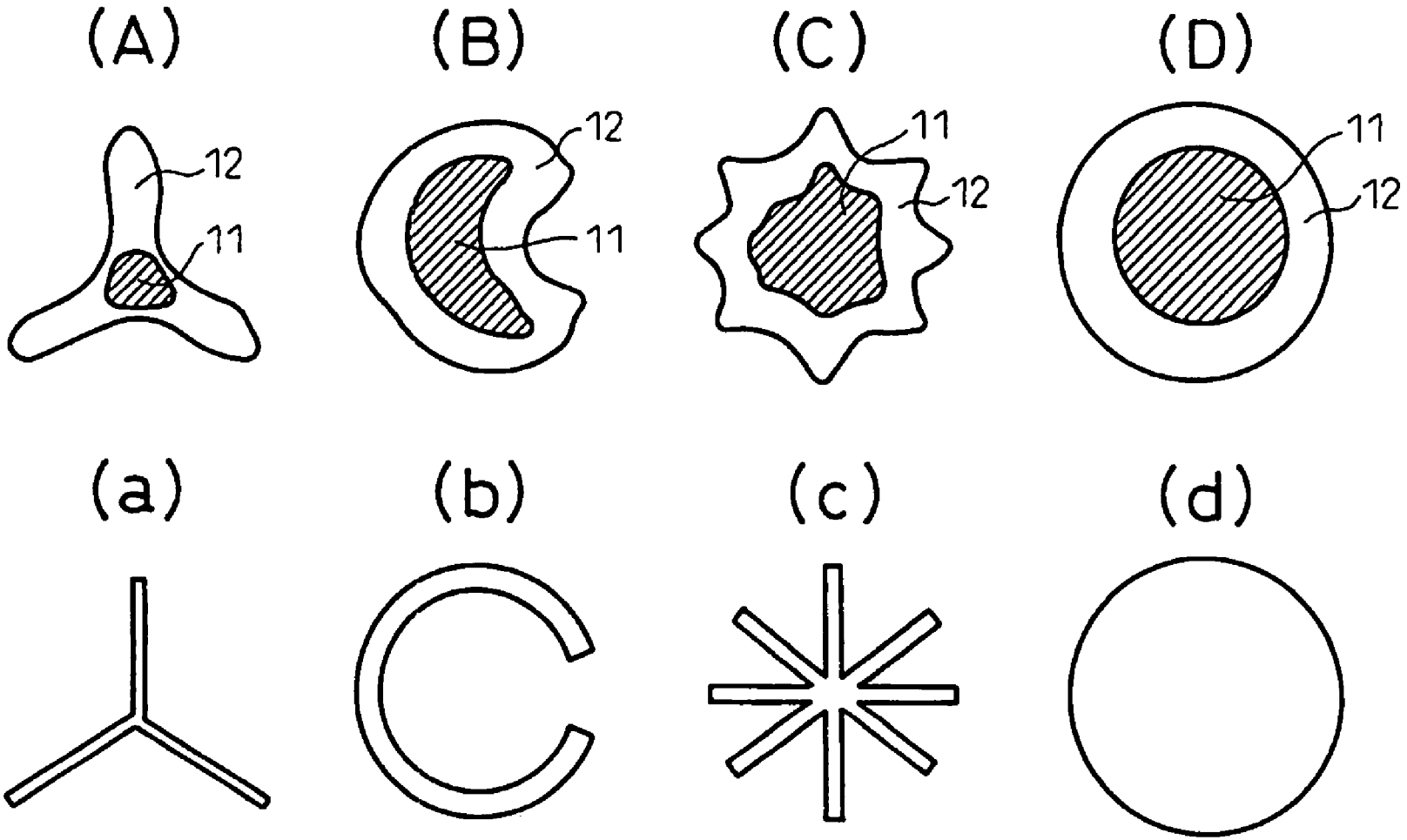

Namely, a fiber-forming synthetic resin is melt-extruded through a melt-spinneret for producing filaments having a desired cross-sectional profile, the extruded filamentary melt streams are taken up at a speed of 500 to 2000 m/min, to produce undrawn filament yarn. In this procedure, a single type of polymer or a polymer blend is used, the resin is melted, the resin melt is extruded through a melt-spinning hole as shown in FIG. 2(*a*) or (*b*) to produce a fiber having a cross-sectional profile as shown in FIG. 2(A) or (B). The fiber having the cross-sectional profile as shown in FIG. 2(A) have the same three concavities as those in the fiber having the cross-sectional profile as shown in FIG. 1. Also, in the cross-sectional profile as shown in FIG. 2-(B), a single concavity is formed. The fibers shown in FIGS. 2-(A) and (B) are formed from a single type of fiber-forming synthetic resin or a blend of two or more fiber-forming synthetic resins. In the case of a core-in-sheath type composite fiber, two types of resins are melted, the two types of resin melts are combined in a cylindrical nozzle arranged upstream to the melt-spinning hole to form a core-in-sheath structure, and the combined melt stream is extruded through a melt spinneret having melt-spinning holes as shown in FIGS. 3-(*d*) to (*f*), to produce composite fibers having the cross-sectional profiles as shown in FIGS. 3-(D) to (F). Also, in the melt spinning procedure as mentioned above, a cooling air is blown toward the resin melt filamentary streams to cool and solidify the melt streams. In this procedure, the D/L ratio of the cross-sectional profile of the resultant fibers can be controlled within the range of from 0.1 to 0.5, by appropriately controlling the flow rate of the cooling air and the location at which the cooling air flow comes into contact with the filamentary melt streams. The resultant undrawn filament yarn is drawn in air at room temperature or in hot water at a temperature of 60 to 95° C. in a single stage or a plurality of stages, at a total draw ratio of 1.2 to 5.0. The drawn filament yarn is oiled with an oiling agent, is optionally crimped by using a stuffing crimper and, thereafter, is cut into a desired fiber length, to provide the staple fibers of the present invention.

The fiber having the cross-sectional profile shown in FIG. 3-(D) is constituted from a fiber-forming synthetic resin for forming a core portion 11 and another fiber-forming synthetic resin for forming a sheath portion 12, to form a core-in-sheath type composite structure having three concavities. The fiber having the cross-sectional profile shown in FIG. 3-(E) is formed from a core portion 11-forming synthetic resin and a sheath portion 12-forming synthetic resin different from each other into a core-in-sheath composite structure having a single concavity. The fiber having the cross-sectional profile shown in FIG. 3-(F) is constituted from a core portion 11-forming synthetic resin and a sheath portion-forming synthetic resin into a core-in-sheath type composite structure having 8 concavities.

There is no limitation to the composition of the oiling agent usable for the above-mentioned procedures. Preferably, an oiling agent comprising 30 to 90% by mass of an alkalic metal salt of an alkylphosphoric acid having 10 to 20 carbon atoms and 10 to 70% by mass of a polydimethylsiloxane and/or a polyoxyethylene-polyoxypropylene-graft copolymerized polysiloxane, to promote the opening property of the fibers. Preferably, the oiling agent is applied at an amount of 0.01 to 5% by mass. If the application amount of the oiling agent is less than 0.01% by mass, when the resultant staple fibers are subjected to an air-laid nonwoven fabric-producing procedure, static electricity is easily generated, and if the application amount of the oiling agent is more than 5% by mass, the resultant staple fibers are easily adhered to each other to form staple fiber bundles, and thus exhibit a degraded air opening property. When the staple fibers of the present invention having the specific irregular cross-sectional profile, as the contact area of the staple fibers with each other become small, and the influence of the change in frictional property of the staple fibers due to the application of the oiling agent becomes small on the air opening property of the resultant staple fibers, the variety in means for impacting a function, for example, hydrophilicizing function, water-repellent function, antibacterial function, deodorant function or aromatic function to the fibers can be expanded.

The melt-spinning holes shown in FIG. 2-(*c*) and FIG. 3-(*g*) are used for producing conventional staple fibers (comparative) having the cross-sectional profiles as shown in FIG. 2-(C) and FIG. 3.-(G). The cross-sectional profile shown in FIG. 2-(C) is circular, and in the core-in-sheath type cross-sectional profile shown in FIG. 3-(G), a core portion 11 having a circular cross-sectional profile is arranged within a sheath portion 12 having a circular cross-sectional profile.

To produce an air-laid nonwoven fabric from the staple fibers of the present invention, a conventional method can be used. By using the staple fibers of the present invention, the air-laid nonwoven fabric having a high quality can be produced. Particularly, the number of defects which is represented by a total number of non-opened fiber bundles and fiber pills having a diameter of 5 mm or more, contained in 1 g of the resultant web, is preferably 10 or less. The term "non-opened fiber bundles" represents fiber bundles formed from the non-opened fibers bundled in parallel to each other and having a cross-sectional major axis of 1 mm or more.

When the staple fibers of the present invention are used, the number of defects generated during the production of the air-laid nonwoven fabric is extremely small, and thus a desired web can be formed with high stability.

The synthetic staple fibers of the present invention optionally contains various functional agents, for example, at least one member selected from deodorant functional agents, antibacterial functional agents, flame retardant functional agents and insect-repellent functional agents. In the staple fibers of the present invention, the functional agent may be mixed into the fiber-forming synthetic resin and preferably the functional agent is applied and fixed to the peripheral surfaces of the staple fibers.

In the conventional staple fibers for the air-laid nonwoven fabric, an increase in the application amount of the functional agent on the staple fiber surfaces, particularly in an application amount of 0.05% by mass or more, causes the air opening property of the resultant staple fibers to be reduced and the quality of the resultant nonwoven fabric to be degraded. When the staple fibers of the present invention are used, the air opening property of the staple fiber is good even when the functional agent is applied in a large amount as mentioned above. The reasons for this advantage is assumed that the functional agent, or a solution or emulsion thereof is trapped in the concavities formed on the peripheral surfaces of the staple fibers, and as a result, the distribution density of the functional agent adhered to the fiber surfaces is reduced.

In view of the functioning property, the concavities allow the functional agent to be held in a large amount in the concavities, and thus, the functional agent can be held in an amount sufficient to exhibit the desired function on the surface of the staple fibers. Even when the functional agent is applied in the state of a liquid, the resultant functional agent-coated layer on the staple fiber surfaces exhibit a high resistance to removal during the formation of the air-laid nonwoven fabric in which a high speed air flow is applied to the staple fiber, due to a high surface tension of the coating layer. Thus, the functional agent layer on the staple fibers of the present invention exhibit a high durability. However, if the functional agent is applied in too a high amount, the air opening property of the staple fibers may be degraded. The amount of the functional agent to be imparted to the staple fibers of the present invention is preferably in the range of from 0.01 to 10% by mass, more preferably from 0.01 to 3% by mass. In the method for applying and fixing the functional agent, to evenly drop the functional agent in the concavities of the staple fibers with a high efficiency, the functional agent is preferably applied in the state of a liquid, such as a solution in water or an organic solvent or an emulsion, prepared by dissolving or emulsifying the functional agent in the state of a liquid, paste, or solid in water or an organic solvent (for example, alcohols or acetone). If the functional agent is applied in the state of a paste or solid, the functional agent is distributed in a high distribution density on portions other than the concavities, of the staple fibers, and this distribution may cause the air opening property of the staple fibers to be degraded. Preferably, the functional agent is applied to the fibers in the form of a filament tow by a conventional oiling method, for example, an oiling roller method or spray method, and then the functional agent-finished filament tow is cut into staple fibers.

There is no limitation to the type of the functional agent. The functional agent usable for the present invention includes surface treatment functional agents which are difficult to be applied in the state of a blend with the oiling agent, for example, deodorants, antibacterial agent, flame retardants and insect (vermin) repellent agents.

In the deodorants, organic deodorants soluble in water or an organic solvent and capable of evenly dispersing are preferably employed rather than inorganic deodorants. As an example, a liquid extract obtained by extract-separating from leaf portions of theaceae plants, for example, camellia. In practice, green tea dry distillation extract S-100 (trademark), made by SHIRAIMATSU SHINYAKU K.K, is usable. To effectively function, the deodorant is preferably retained in an amount of 0.01% by mass or more, more preferably 0.02% by mass or more, on the staple fibers.

The antibacterial agent includes, as an example, tertiary ammonium antibacterial agents. In practice, NIKKANON RB (trademark, N-polyoxyethylene-N,N,N-trialkylammonium salt), made by NIKKA KAGAKU K.K. is preferably used. Also, amino glycosides (glycosides of aminosaccharide with monosaccharide, multi- or polysaccharide), for example, ST-7, ST-8, ST-9, ST-835, ST-836, and ST-845 (trademark), made by K.K. BIOMATERIAL, are preferable examples of the antibacterial agent. To effectively function, the antibacterial agent is preferably retained in an amount of 0.01% by mass or more, more preferably 0.02% by mass or more, on the staple fibers.

The flame retardants include, for example, halogenated cycloalkane compounds. The term "halogenated cycloalkane compounds" includes compounds in which at least one hydrogen atom in cyclic saturated hydrocarbons, or saturated hydrocarbon compounds having at least one cyclic saturated hydrocarbon structure is substituted by a halogen atom. The halogenated cycloalkane compounds include, for example, 1,2,3,4,5,6-hexabromocyclohexane, 1,2,3,4- or 1,2,4,6-tetrabromocyclooctane and 1,2,5,6,9,10-hexabromocyclododecane, 1,2-bis(3,4-dibromocyclohexyl)1,2-dibromoethane, and substituted compounds in which the bromine atoms in the mentioned bromo compounds, are substituted by chlorine atoms. The flame retardants usable for the present invention are not limited to the above-mentioned compounds. To impart a good flame retardant property, the halogenated cycloalkane compounds are preferably retained in an amount of 0.5% by mass or more on the staple fibers.

The vermin-repellent agents include pyrethroid components, for example, 3-phenoxybenzyl-dl-cis/trans-3-(2,2-dichlorovinyl)-2,2-dimethyl-cyclopropane-1-carboxylate (Common name: Permetrin), (3-phenoxyphenyl)methyl ester of 2-dimethyl-3-(2-methylpropenyl)cyclopropane carboxylic acid (Common name: Phenotrin). To function effectively, the vermin-repellent agent is preferably retained in an amount of 0.01% by mass or more, more preferably 0.1% by mass or more, on the staple fibers.

EXAMPLES

The present invention will be further explained in detail the following examples which are not intended to limit the scope of the present invention in any way.

In each of the examples and comparative examples the following measurements were carried out.

(1) Intrinsic Viscosity [η]

The intrinsic viscosity was measured at a temperature of 35° C. in o-chlorophenol as a solvent.

(2) Melt Flow Rate (MFR)

The melt flow rate of the synthetic resin subjected to the measurement was determined in accordance with the method described in JIS K 7210.

(3) Melting Point ($T_m$)

The melting point ($T_m$) was represented by an endothermic peak temperature in a DSC curve prepared according to the differential scanning calorimetric measurement (DSC) described in JIS K 7121.

(4) Softening Point ($T_s$)

A test piece having a length of 126 mm, a width of 12 mm and a thickness of 3 mm was prepared from a synthetic resin subjected to the measurement. A Vicat softening test was carried out on the test piece in accordance with JIS K 7206, and the heat transfer medium temperature was measured when a needle indenter was intruded to the depth of 1 mm.

(5) Thickness

The thickness of staple fibers subjected to the measurement was measured in accordance with the method described in JIS L1015 7.5.1 A.

(6) Fiber Length

The fiber length of the staple fibers subjected to the measurement was measured in accordance with the method described in JIS L1015, 7.4.1 C method.

(7) Number of Crimps, Percentage of Crimp

Individual filaments were taken out from a crimped filament tow before the tow was cut into a desired fiber length, and the number of crimps and the percentage of crimp of the individual filaments were measured in accordance with the method described in JIS L1015 7.12.

(8) Pickup of Oiling Agent

Fibers having a mass (F) were subjected to an extraction with methanol at 30° C. in a liquor ratio of 1:20 for 10 minutes. The dry mass (E) of an extraction residue was measured. The measured dry mass (E) was dividing with the fiber mass (F). The resultant quotient in % represented the pickup of the oiling agent on the fibers.

(9) Water Content of Staple Fibers

The water content of staple fibers was determined in accordance with the method described in JIS L1015 7.2.

(10) Ratio D/L of Concavity

A microscopic photograph of a cross sectional profile of a staple fiber (section photograph) was taken, and the contour of the cross-sectional profile of the fiber was traced on a tracing paper sheet, D and L, as explained below, were determined with a ruler, and the ratio D/L was calculated in accordance with the following equation:

$$D/L \text{ ratio} = D/L \times 100$$

wherein L represents a longest width of opening of the concavity (represented by a distance between a tangent line drawn to a pair of convexities defining the opening of the concavity and two points of contact of the tangent line with the two convexities, and D represents a largest depth of the concavity (measured from the tangent line in the direction at right angles to the tangent line.

(11) Number of Defects of Air-Laid Web

An air-laid web composed of 100% of staple fibers and having a basis mass of 30 g/m$^2$ was produced by using a forming drum unit (600 mm wide, the form of holes of the forming drum: rectangular 2.4 mm×20 mm, opening area: 40%) under the conditions of the rate of drum rotation of 200 rpm; the number of rotation of a needle roll of 900 rpm; and the transportation speed of the web of 30 m/min. Ten samples each having a mass of 1 g were randomly collected from 10 respective sites of the web. For each sample, the number of non-opened fiber bundles having a cross-sectional major axis of 1 mm or more) and pills having a diameter of 5 mm or more per g of the sample, was counted. The average of the total number of defects per g of the web sample was calculated. When the number of defects was 10 or less, the web passed the test.

Example 1

A high density polyethylene (HDPE) having a MFR of 20 g/10 min and a $T_m$ of 131° C. and a poly(ethylene terephthalate) (PET) vacuum dried at 120° C. for 16 hours and having an intrinsic viscosity [η] of 0.61 and a $T_m$ of 256° C. were melted separately from each other by separate extruders to prepare a polyethylene melt having a temperature of 250° C. and a polyester melt having a temperature of 280° C. The polyethylene melt was used as a sheath component A and the polyester melt was used as a core component B. The sheath component (A) resin melt streams and the core component B resin melt streams were combined in a combination mass ratio A:B of 50:50 through a melt-spinneret for forming a core-in-sheath type composite yarn having 450 extrusion holes in the form as shown in FIG. 3(*d*), to form a core-in-sheath type composite resin melt streams, and the resultant core-in-sheath type composite streams were melt-extruded through the spinneret. In this melt-spinning procedure, the spinneret temperature was established at 280° C., and the extrusion rate was established at 150 g/min. Then, the extruded composite filamentary resin melt streams was air cooled with a cooling air flow having a temperature of 30° C. at a location 30 mm below the spinneret, and wound at a speed of 1,150 m/min, to provide an undrawn filament yarn. The undrawn filament yarn was drawn at a draw ratio of 3 in hot water at 75° C. An oiling agent comprising 80 parts by mass of potassium salt of laurylphosphoric acid and 20 parts by mass of polyoxyethylene-modified silicone was imparted in a pickup of the oiling agent of 0.22% by mass to the drawn filament yarn. The oiling agent-applied drawn filament yarn was crimped with plane zigzag type crimps in the number of crimps of 17 crimps/25 mm and a percentage of crimp of 8%, by using a stuffing crimper. The resultant filament yarn was then dried at 105° C. for 60 minutes, and cut with a rotary cutter into a fiber length of 5 mm.

The resultant staple fibers had a thickness of 1.1 dtex, and had a cross sectional profile as shown in FIG. 3-(D). The test results are shown in Table 1.

Examples 2 and 3 and Comparative Example 1

In each of Examples 2 to 3 and Comparative Example 1, core-in-sheath type composite staple fibers were produced in the same manner as in Example 1 except that the extrusion holes of the spinneret were changed to those having a cross-sectional profiles as shown in FIG. 3-(*e*), -(*f*) and -(*g*). The test results are shown in Table 1.

Comparative Example 2

Core-in-sheath type composite staple fibers were produced under the same conditions as in Example 1, except that the cooling position of the extruded composite filamentary resin melt streams was changed to a location 70 mm below the spinneret. The test results are shown in Table 1.

Example 4

Core-in-sheath type composite staple fibers were produced under the same conditions as in Example 1, except that no stuffing crimper was employed not to impart crimps to the staple fibers. Table 1 shows the test results.

Comparative Example 3

Core-in-sheath type composite staple fibers were produced under the same conditions as in Comparative Example 1, except that no stuffing crimper was used, not to impart crimps to the staple fibers. Table 1 shows the results.

Examples 5 to 6

In each of Examples 5 and 6, core-in-sheath type composite staple fibers were produced, in the same manner as in Example 1 except that the number of crimps was changed to 5 crimps/25 mm in Example 5 and to 40 crimps/25 mm in Example 6 by controlling the feed rate of the drawn filament yarn to the stuffing crimper and the stuffing pressure to the filament yarn. Table 1 shows the test results.

Example 7 and Comparative Example 4

Core-in-sheath type composite staple fibers were produced in Example 7, in the same manner as in Comparative Example 1, and in Comparative Example 4, in the same manner as in Comparative Example 1, except that the oiling agent-applied, drawn filament yarn was dried at 105° C., moisturized and cut into a fiber length of 0.1 mm by using a Guillotine cutter. The resultant staple fibers of Example 7 and Comparative Example 4 respectively had a water content of 10% by mass. Table 1 shows the test results.

Example 8

Core-in-sheath type composite staple fibers were produced in the same manner as in Example 1 except that the extrusion holes of the spinneret were changed to those having the same cross-sectional profile as in FIG. 3-(*f*), except that the number of the radial slits was changed to 30. Table 1 shows the test results.

Example 9

Core-in-sheath type composite staple fiber were produced in the same manner as in Example 1 except that the fiber length was changed to 45 mm. Table 1 shows the test results. 2-(*b*) for Example 1 and in FIG. 2-(*c*) for Comparative Example 5. Table 2 shows the test results.

Example 11 and Comparative Example 5

In each of Example 11 and Comparative Example 5, staple fibers were produced in the same manner as in Example 10, except that the extrusion holes of the spinneret were changed to those having a cross-sectional profile as shown in FIG.

TABLE 1

| | Resin core component/ sheath component | Cross sectional profile of fiber | Number of concavities | D/L ratio | Thickness (dtex) | Fiber length (mm) | Number of crimps (crimps/25 mm) | Water content (% by mass) | Number of non-opened fiber bundles (per g) | Number of pills (per g) | Number of defects (per g) |
|---|---|---|---|---|---|---|---|---|---|---|---|
| Ex. 1 | PET/HDPE | (D) | 3 | 0.25 | 1.1 | 5 | 17 | 0.7 | 1 | 0 | 1 |
| Ex. 2 | PET/HDPE | (E) | 1 | 0.45 | 1.1 | 5 | 17 | 0.7 | 1 | 0 | 1 |
| Ex. 3 | PET/HDPE | (F) | 8 | 0.15 | 1.1 | 5 | 17 | 0.7 | 2 | 0 | 2 |
| Comp. Ex. 1 | PET/HDPE | (G) | 0 | — | 1.1 | 5 | 17 | 0.7 | 20 | 0 | 20 |
| Comp. Ex. 2 | PET/HDPE | (D) | 3 | 0.5 | 1.1 | 5 | 17 | 0.7 | 17 | 0 | 17 |
| Ex. 4 | PET/HDPE | (D) | 3 | 0.25 | 1.1 | 5 | 0 | 0.7 | 2 | 0 | 2 |
| Comp. Ex. 3 | PET/HDPE | (G) | 0 | — | 1.1 | 5 | 0 | 0.7 | 35 | 0 | 35 |
| Ex. 5 | PET/HDPE | (D) | 3 | 0.25 | 1.1 | 5 | 5 | 0.7 | 3 | 0 | 3 |
| Ex. 6 | PET/HDPE | (D) | 3 | 0.25 | 1.1 | 5 | 40 | 0.7 | 8 | 0 | 8 |
| Ex. 7 | PET/HDPE | (D) | 3 | 0.25 | 1.1 | 0.1 | 13 | 10 | 7 | 0 | 7 |
| Comp. Ex. 4 | PET/HDPE | (G) | 0 | — | 1.1 | 0.1 | 13 | 10 | 90 | 0 | 90 |
| Ex. 8 | PET/HDPE | — | 30 | 0.25 | 1.1 | 5 | 15 | 0.7 | 6 | 0 | 6 |
| Ex. 9 | PET/HDPE | (D) | 3 | 0.25 | 1.1 | 45 | 15 | 0.7 | 4 | 4 | 8 |

Note:
PET . . . Polyethylene terephthalate resin
HDPE . . . High density polyethylene resin Example 10

A poly(ethylene terephthalate) (PET) vacuum dried at 120° C. for 16 hours and having an intrinsic viscosity [η] of 0.61 and a $T_m$ of 256° C. was melted at a temperature of 280° C. and the resultant resin melt was extruded through a melt spinneret having 450 extrusion holes with the form as shown in FIG. 2-(*a*). The spinneret temperature was controlled to 280° C., and the extrusion rate was controlled to 150 g/min. Moreover, the extruded filamentary resin melt streams were air-cooled by blowing cooling air at 30° C. at a location 35 mm below the spinneret, and the resultant filament bundle were wound at a speed of 1,000 m/min to provide an undrawn filament yarn. The undrawn filament yarn was drawn at a draw ratio of 3.2 in hot water at 70° C., and then further drawn at a draw ratio of 1.15 in hot water at 90° C. The resultant drawn filament yarn was oiled with an oiling agent comprising potassium salt of laurylphosphoric acid and polyoxyethylene-modified silicone in a mass ratio of 80/20 in a pickup of the oiling agent of 0.18% by mass. Then the oiled filament yarn was subjected to a crimping step using a stuffing crimper to impart plane zigzag-type crimps to the oiled filament yarn at the number of crimps of 16 crimps/25 mm and a percentage of crimp of 12%. The resultant yarn was then dried at 130° C. for 60 minutes, the dried drawn filament yarn was cut into a fiber length of 5 mm with a rotary cutter. The resultant staple fibers had a thickness of 1.0 dtex, and had a cross sectional profile as shown in FIG. 2-(A). Table 2 shows the test results.

Comparative Example 6

Staple fibers were produced in the same manner as in Example 10, except that the extruded filamentary resin melt streams were cooled at a location 70 mm below the spinneret. Table 2 shows the test results.

Comparative Example 7

Staple fibers were produced in the same manner as in Example 10, except that the cooling portion of the extruded filamentary resin melt streams was changed to a location 20 mm below the spinneret. Table 2 shows the test results.

Example 12 and Comparative Example 8

Staple fibers of Example 12 were produced in the same manner as in Example 10, and the staple fibers of Comparative Example 8 were produced in the same manner as in Comparative Example 5, except that the extrusion rate was changed to 100 g/min, the winding speed was changed to 1200 m/min, the draw ratio in the 70° C. hot water was changed to 2.85 and the number of crimps was changed to 18 crimps/25 mm. Table 2 shows the test results.

Example 13 and Comparative Example 9

Staple fibers were produced in Example 13 in the same manner as in Example 10 and, in Comparative Example 9 in the same manner as in Comparative Example 5, each except that the extrusion rate was changed to 680 g/min, the winding speed was changed to 900 m/min, the draw ratio in 70° C. hot water was changed to 3.4, and the number of crimps was changed to 9 crimps/25 mm. Table 2 shows the test results.

TABLE 2

| | Resin | Cross sectional profile of fiber | Number of recessed portions | D/L ratio | Thickness (dtex) | Fiber length | Number of crimps (per 25 mm) | Water content (% by mass) | Number of non-opened fiber bundles (per g) | Number of pills (per g) | Number of defects (per g) |
|---|---|---|---|---|---|---|---|---|---|---|---|
| Ex. 10 | PET | (A) | 3 | 0.30 | 1.0 | 5 | 16 | 0.7 | 2 | 0 | 2 |
| Ex. 11 | PET | (B) | 1 | 0.40 | 1.0 | 5 | 15 | 0.7 | 2 | 0 | 2 |
| Comp. Ex. 5 | PET | (C) | 0 | — | 1.0 | 5 | 16 | 0.7 | 20 | 3 | 23 |
| Comp. Ex. 6 | PET | (A) | 3 | 0.03 | 1.0 | 5 | 17 | 0.7 | 12 | 2 | 14 |
| Comp. Ex. 7 | PET | (B) | 1 | 0.55 | 1.0 | 5 | 12 | 0.7 | 12 | 1 | 13 |
| Ex. 12 | PET | (A) | 3 | 0.27 | 0.6 | 5 | 18 | 0.7 | 5 | 2 | 7 |
| Comp. Ex. 8 | PET | (C) | 0 | — | 0.6 | 5 | 18 | 0.7 | 45 | 10 | 55 |
| Ex. 13 | PET | (A) | 3 | 0.32 | 4.4 | 5 | 9 | 0.7 | 1 | 0 | 1 |
| Comp. Ex. 9 | PET | (C) | 0 | — | 4.4 | 5 | 9 | 0.7 | 11 | 2 | 13 |

Example 14

A low softening point copolymerized poly(ethylene terephthalate isophthalate) (coPET; copolymerized with 40% by mole of isophthalic acid and 4% by mole of diethylene glycol) vacuum dried at 35° C. for 48 hours and having an intrinsic viscosity [η] of 0.54 and a $T_s$ of 65° C. and a poly (ethylene terephthalate) (PET) vacuum dried at 120° C. for 16 hours and having an intrinsic viscosity [η] of 0.61 and a $T_m$ of 256° C. were separately melted with separate extruders. The coPET melt having a temperature of 250° C. was used for a sheath component (A) and the PET melt having a temperature of 280° C. was used for a core component (B). The coPET melt for the sheath component (A) and the PET melt for the core component (B) were extruded in a mass ratio A:B of 50:50 through a melt spinneret for a core-in-sheath type composite fiber having an extrusion holes having the form as shown in FIG. 3-(*d*), to form core-in-sheath type composite filamentary resin melt streams. In this procedure, the spinneret temperature was controlled to 280° C., and the extrusion rate was controlled to 300 g/min. Moreover, the extruded filamentary resin melt streams were air cooled with a cooling air-blow at 30° C. at a location 30 mm below the spinneret, the resultant undrawn filament yarn was wound at a speed of 1,200 m/min. The undrawn filament yarn was drawn at a draw ratio 2.85 in hot water at 70° C., and further drawn at a draw ratio of 1.15 in hot water at 90° C. The drawn filament yarn was oiled with an oiling agent comprising potassium salt of laurylphosphoric acid and polyoxyethylene-modified silicone in a mass ratio of 80:20 in a pickup of the oiling agent of 0.25% by mass. The oiled drawn filament yarn was fed into a stuffing crimper to impart plane zigzag type crimps in a number of crimps of 11 crimps/25 mm at a percentage of crimp of 9%. The resultant crimped filament yarn was then dried at 55° C. for 60 minutes, and cut into a fiber length of 5 mm with a rotary cutter. The resultant staple fibers had a thickness of 1.7 dtex and a cross sectional profile as shown in FIG. 3-(D). Table 3 shows the test results.

Comparative Example 10

Staple fibers were produced in the same manner as in Example 14 except that the form of the extrusion holes was changed to that shown in FIG. 3-(*g*). Table 3 shows the test results.

Example 15

A polyester elastomer (EL) vacuum dried at 35° C. for 48 hours, having an intrinsic viscosity [η] of 0.8 and a $T_m$ of 152° C., and comprising hard segments comprising a 15% by mole of isophthalic acid-copolymerized poly(butylene terephthalate) and the soft segments comprising a poly(tetramethylene glycol) having an average molecular weight of 1,500, and a poly(ethylene terephthalate) (PET) dried at 120° C. for 16 hours and having an intrinsic viscosity [η] of 0.61 and a $T_m$ of 256° C., were separately melted with separate extruders to provide a EL melt having a temperature of 240° C. and a PET melt having a temperature of 280° C. The EL melt was used for sheath component A, and the PET melt was used for a core component B. The EL melt and the PET melt were extruded in a mass ratio A/B=50/50 through a melt-spinneret having 450 extrusion holes as shown in FIG. 3-(*d*) for a core-in-sheath type composite fiber, to form core-in-sheath type composite filamentary resin melt streams. In this procedure, while the spinneret temperature was controlled to 280° C., and the extrusion rate was controlled to 310 g/min. Moreover, the extruded filamentary resin melt streams were air cooled with cooling air at 30° C. at a location 30 mm below the spinneret, and the resultant undrawn filament yarn was wound at a speed of 1,100 m/min. The resultant undrawn filament yarn was then drawn at a draw ratio of 2.6 in hot water at 70° C., and further drawn at a draw ratio of 1.15 in hot water at 90° C. Then the drawn filament yarn was oiled with a oiling agent comprising potassium salt of laurylphosphoric acid and polyoxyethylene-modified silicone in a mass ratio of 80:20 in a pickup of the oiling agent 0.25% by mass. The oiled filament yarn was fed into a stuffing crimper to impart plane zigzag type crimps at a number of crimps of 8 crimps/25 mm and a percentage of crimp of 6%. The resultant crimped filament yarn was then dried at 70° C. for 60 minutes, and cut into a fiber length of 5 mm with a rotary cutter. The resultant staple fibers had a thickness of 2.5 dtex and a cross sectional profile as shown in FIG. 3-(D). Table 3 shows the test results.

Comparative Example 11

Staple fibers were produced in the same manner as in Example 15 except that the extrusion holes of the spinneret were changed to those having a form as shown in FIG. 3-(*g*). Table 3 shows the test results.

Example 16

A polypropylene (PP) having a MFR of 50 g/10 min and a $T_m$ of 158° C. and a poly(ethylene terephthalate) (PET) vacuum dried at 120° C. for 16 hours and having an intrinsic viscosity [η] of 0.61 and a $T_m$ of 256° C. were separately melted with separate extruders. The PP melt having a temperature of 260° C. was used for a sheath component A and the PET melt having a temperature of 280° C. was used for a core component (B). The PP melt and the PET melt were fed in a mass ratio A/B of 50:50 to a core-in-sheath type composite spinneret having 450 extrusion holes with a shape as shown in FIG. 3-(*d*) and extruded through the spinneret to provide core-in-sheath type composite filamentary streams. In this procedure, the spinneret temperature was controlled to 280° C., and the extrusion rate was controlled to 190 g/min. Moreover, the extruded filamentary resin melt streams were air cooled with a cooling air flow at 30° C. at a location 30 mm below the spinneret, and wound the resultant undrawn filament yarn was at a speed of 1,150 m/min. The undrawn filament yarn was drawn at a draw ratio of 2.9 in hot water at 75° C., and then oiled with an oiling agent comprising potassium salt of laurylphosphoric acid and polyoxyethylene-modified silicone in a mass ratio of 80:20 in a pickup of the oiling agent 0.25% by mass. The oiled filament yarn was fed to a stuffing crimper to impart plane zigzag type crimps to the drawn yarn at a number of crimps of 13 crimps/25 mm and a percentage of crimps of 11%. The resultant crimped filament yarn was then dried at 105° C. for 60 minutes, and then cut into a fiber length of 5 mm with a rotary cutter. The resultant staple fibers had a thickness of 1.5 dtex and a cross-sectional profile as shown in FIG. 3-(D). Table 3 shows the test results.

Comparative Example 12

Staple fibers were produced in the same manner as in Example 16, except that the extrusion holes of the spinneret were changed to those as shown in FIG. 3-(*g*). Table 3 shows the test results.

Example 17

A high pressure-processed low density polyethylene (LDPE) having a MFR of 20 g/10 min and a $T_m$ of 113° C. and a poly(ethylene terephthalate) (PET) vacuum dried at 120° C. for 16 hours and having an intrinsic viscosity [η] of 0.61 and a $T_m$ of 256° C. were separately melted with separate extruders, to provide a LDPE melt having a temperature of 250° C. and a PET melt having a temperature of 280° C. The LDPE melt was used for a sheath component A and the PET melt was used for a core component B. The LDPE melt and the PET melt were extruded at a mass ratio A/B of 50:50 through a core-in-sheath type composite spinneret having 450 extrusion holes as shown in FIG. 3-(*d*) to form core-in-sheath type composite filamentary resin melt streams. In this procedure, the spinneret temperature was 280° C., and the extrusion rate was 200 g/min. Moreover, the extruded filamentary resin melt streams were air cooled with a cooling air flow at 30° C. at a location 30 mm below the spinneret, and the resultant undrawn filament yarn was wound at a speed of 1,100 m/min. The undrawn filament yarn was drawn at a draw ratio of 2.8 in hot water at 75° C., and oiled with an oiling agent comprising potassium salt of laurylphosphoric acid and polyoxyethylene-modified silicone at a mass ratio of 80:20 in a pickup of the oiling agent of 0.25% by mass. The oiled filament yarn was fed to a stuffing crimper to impart plane zigzag type crimps to the drawn filament yarn at a number of crimps of 14 crimps/25 mm and in a percentage of crimp of 11%. The resultant filament yarn was then dried at 95° C. for 60 minutes, and cut into a fiber length of 5 mm with a rotary cutter. The resultant staple fibers had a thickness of 1.7 dtex and a cross-sectional profile as shown in FIG. 3-(D). Table 3 shows the test results.

Comparative Example 13

Staple fibers were produced in the same manner as in Example 17 except that the extrusion holes of the spinneret were changed to those having a shape as shown in FIG. 3-(*g*). Table 3 shows the test results.

Example 18

A linear low density polyethylene (LLDPE) having a MFR of 30 g/10 min and a $T_m$ of 122° C. and a poly(ethylene terephthalate) (PET) vacuum dried at 120° C. for 16 hours and having an intrinsic viscosity [η] of 0.61 and a $T_m$ of 256° C. were separately melted with separate extruders, to prepare a LLDPE melt having a temperature of 250° C. and a PET melt having a temperature of 280° C., the LLDPE melt was used for a sheath component A and the PET melt was used for a core component B. The LLDPE melt and the PET melt were extruded in a mass ratio A:B of 50:50 through a core-in-sheath type composite spinneret having 450 extrusion holes, having the form as shown in FIG. 3-(*d*), to provide core-in-sheath type composite filamentary resin melt streams. In this procedure, the spinneret temperature was 280° C., and the injection amount was 200 g/min. Moreover, the extruded filamentary resin melt streams were air cooled with a cooling air flow at 30° C. at a location 30 mm below the spinneret, and the resultant undrawn filament yarns was wound at a speed of 1,100 m/min. The undrawn filament yarn was drawn at a draw ratio of 2.8 in hot water at. 75° C. and oiled with an oiling agent comprising potassium salt of laurylphosphoric acid and polyoxyethylene-modified silicone in a mass ratio of 80:20 in a pickup of the oiling agent of 0.25% by mass. The oiled filament yarn was fed into a stuffing crimper to impart plane zigzag type crimps to the drawn filament yarn at a number of crimps of 13 crimps/25 mm and at a percentage of crimp of 11%. The resultant yarn was then dried at 95° C. for 60 minutes, and cut into a fiber length of 5 mm with a rotary cutter. The resultant staple fibers had a thickness of 1.7 dtex and a cross sectional profile as shown in FIG. 3-(D). Table 3 shows the test results.

Comparative Example 14

Staple fibers were produced in the same manner as in Example 18 except that the extrusion holes of the spinneret were changed to those having a form as shown in FIG. 3-(*g*). Table 3 shows the test results.

TABLE 3

| | Resin core/sheath | Fiber cross sectional profile | Number of concavities | D/L ratio | Thickness (dtex) | Fiber length | Number of crimps (per 25 mm) | Water content (% by mass) | Number of non-opened fiber bundles (per g) | Number of pills (per g) | Number of defects (per g) |
|---|---|---|---|---|---|---|---|---|---|---|---|
| Ex. 14 | PET/coPET | (D) | 3 | 0.15 | 1.7 | 5 | 11 | 1.3 | 5 | 2 | 7 |
| Comp. Ex. 10 | PET/coPET | (G) | 0 | — | 1.7 | 5 | 11 | 1.3 | 60 | 15 | 75 |
| Ex. 15 | PET/EL | (D) | 3 | 0.12 | 2.5 | 5 | 8 | 1.5 | 2 | 2 | 4 |
| Comp. Ex. 11 | PET/EL | (G) | 0 | — | 2.5 | 5 | 8 | 1.5 | 20 | 7 | 27 |
| Ex. 16 | PET/PP | (D) | 3 | 0.16 | 1.5 | 5 | 13 | 0.3 | 3 | 0 | 3 |
| Comp. Ex. 12 | PET/PP | (G) | 0 | — | 1.5 | 5 | 13 | 0.3 | 30 | 3 | 33 |
| Ex. 17 | PET/LDPE | (D) | 3 | 0.21 | 1.7 | 5 | 14 | 0.7 | 5 | 2 | 7 |
| Comp. Ex. 13 | PET/LDPE | (G) | 0 | — | 1.7 | 5 | 14 | 0.7 | 35 | 10 | 45 |
| Ex. 18 | PET/LLDPE | (D) | 3 | 0.20 | 1.7 | 5 | 13 | 0.7 | 5 | 2 | 7 |
| Comp. Ex. 14 | PET/LLDPE | (G) | 0 | — | 1.7 | 5 | 13 | 0.7 | 39 | 11 | 50 |

Example 19

A high density polyethylene (HDPE) having a MFR of 20 g/10 min and a $T_m$ of 131° C. and a poly(ethylene terephthalate) (PET) vacuum dried at 120° C. for 16 hours and having an intrinsic viscosity [η] of 0.61 and a $T_m$ of 256° C. were melted separately from each other by separate extruders to prepare a polyethylene melt having a temperature of 250° C. and a polyester melt having a temperature of 280° C. The polyethylene melt was used as a sheath component A and the polyester melt was used as a core component B. The sheath component (A) resin melt streams and the core component B resin melt streams were combined in a combination mass ratio A:B of 50:50 through a melt-spinneret for forming a core-in-sheath type composite yarn having 450 extrusion holes in the form as shown in FIG. 3(*d*), to form a core-in-sheath type composite resin melt streams, and the resultant core-in-sheath type composite streams were melt-extruded through the melt spinneret. In this melt-spinning procedure, the spinneret temperature was established at 280° C., and the extrusion rate was established at 150 g/min. Then, the extruded composite filamentary resin melt streams were air cooled with a cooling air flow having a temperature of 30° C. at a location 30 mm below the spinneret, and wound at a speed of 1,150 m/min, to provide an undrawn filament yarn. The undrawn filament yarn was drawn at a draw ratio of 3 in hot water at 75° C. An oiling agent comprising 80 parts by mass of potassium salt of laurylphosphoric acid and 20 parts by mass of polyoxyethylene-modified silicone was imparted in a pickup of the oiling agent of 0.19% by mass to the drawn filament yarn. The oiling agent-applied drawn filament yarn was crimped with plan zigzag type crimps in the number of crimps of 12 crimps/25 mm and a percentage of crimp of 7%, by using a stuffing crimper. The resultant filament yarn was then dried at 105° C. for 60 minutes, and then subjected to a procedure in which an aqueous solution of a deodorant functional agent S-100 (trademark, green tea dry distillation extract, made by SHIRAIMATSU SHINYAKU K.K.), in a concentration of 10% by mass was applied to the crimped filament yarn to an extent such that the aqueous solution is picked up in an amount of 1% by mass on the filament yarn (a theoretical pickup of the deodorant functional agent was 0.1% by mass on the basis of the mass of the filament yarn), by using an oiling roller. Then the deodorant-functioned filament yarn was cut with a rotary cutter into a fiber length of 5 mm. The resultant staple fibers had a thickness of 1.1 dtex, and had a cross sectional profile as shown in FIG. 3-(D). The test results are shown in Table 4.

Examples 20 and 21 and Comparative Example 15

In each of Examples 20 and 21 and Comparative Example 15, staple fibers were produced in the same manner as in Example 19, except that the extrusion holes of the spinneret were changed respectively those as shown in FIG. 3-(*e*), (*f*) and (*g*).

The test results are shown in Table 4.

Example 22

Core-in-sheath type composite staple fibers were produced in the same manner as in Example 19 except that the extrusion holes of the spinneret were changed to those having the same cross-sectional profile as in FIG. 3-(*f*), except that the number of the radial slits was changed to 30. Table 4 shows the test results.

Example 23 and Comparative Example 16

In Example 23 and Comparative Example 16, core-in-sheath type composite staple fibers were produced in the same manner as in Example 19 (for Example 23) and Comparative Example 15 (for Comparative Example 16), except that in place of the deodorant functional agent S-100, a 5% by mass aqueous solution of an antibacterial functional agent, NIKKANON RB (trademark, N-polyoxyethylene-N,N,N-trialkyl ammonium salt) was applied to the crimped filament yarn to an extent such that the aqueous solution of the antibacterial functional agent was picked up in an amount of 5% by mass on the filament yarn (the theoretical pickup of the antibacterial functional agent was 0.25% by mass on the basis of the mass of the filament yarn).

Table 4 shows the test results.

Example 24 and Comparative Example 17

In Example 24 and Comparative Example 17, core-in-sheath type composite staple fibers were produced in the same manner as in Example 19 and Comparative Example 15, respectively, except that in place of the deodorant functional agent S-100, an aqueous emulsion of flame retardant YM88 (trademark, hexabromocyclododecane, made by DAIICHI KOGYO SEIYAKU K.K.) in a concentration of 10% by mass was applied to the crimped filament yarn to an extent such that the aqueous emulsion of the flame retardant functional agent is picked up in an amount of 10% by mass on the filament-yarn (the theoretical pickup of the flame retardant functional agent was 1.0% by mass on the basis of the mass of the filament yarn). The test results are shown in Table 4.

Example 25 and Comparative Example 18

In Example 25 and Comparative Example 18, core-in-sheath type composite staple fibers were produced in the same manner as in Example 19 (for Example 25) and Comparative Example 15 for Comparative Example 18, except that, in place of the deodorant functional agent S-100, a 10% by mass aqueous liquid of d-Phenotrin was applied to the crimped filament yarn to an extent such that d-Phenotrin was picked up in an amount of 5% by mass on the filament yarn (the theoretical pickup of d-Phenotrin was 0.5% by mass on the basis of mass of the filament yarn). The test results are shown in Table 4.

Example 26

A poly(ethylene terephthalate) (PET) vacuum dried at 120° C. for 16 hours and having an intrinsic viscosity [η] of 0.61 and a $T_m$ of 256° C. was melted at a temperature of 280° C. and the resultant resin melt was extruded through a melt spinneret having 450 extrusion holes with the form as shown in FIG. 2-(*a*). The spinneret temperature was controlled to 280° C., and the extrusion rate was controlled to 150 g/min. moreover, the extruded filamentary resin melt streams were air-cooled by blowing a cooling air flow at 30° C. at a location 35 mm below the spinneret, and the resultant filament bundle was wound at a speed of 1,000 m/min to provide an undrawn filament yarn. The undrawn filament yarn was drawn at a draw ratio of 3.2 in hot water at 70° C., and then further drawn at a draw ratio of 1.15 in hot water at 90° C. The resultant drawn filament yarn was oiled with an oiling agent comprising potassium salt of laurylphosphoric acid and polyoxyethylene-modified silicone in a mass ratio of 80/20 in a pickup of the oiling agent of 0.18% by mass. Then the oiled filament yarn was subjected to a crimping step using a stuffing crimper to impart plane zigzag type crimps to the oiled filament yarn at the number of crimps of 16 crimps/25 mm and a percentage of crimp of 12%. The resultant yarn was then dried at 130° C. for 60 minutes, the dried drawn filament yarn was subjected to a procedure in which a 10% by mass aqueous solution of a deodorant functional agent, S-100 (trademark, green tea dry distillation extract) was applied to the crimped filament yarn to an extent such that the deodorant functional agent was picked up in an amount of 1% by mass on the filament yarn (the theoretical pickup of the deodorant functional agent was 0.1% by mass on the basis of the mass of the filament yarn), by using an oiling roller. Then the deodorant-functional filament yarn was cut into a fiber length of 5 mm with a rotary cutter. The resultant staple fibers had a thickness of 1.0 dtex, and had a cross sectional profile as shown in FIG. 2-(A). Table 4 shows the test results.

Example 27 and Comparative Example 19

In each of Example 27 and Comparative Example 19, staple fibers were produced in the same manner as in Example 26, except that the extrusion holes of the spinneret were changed to those having a cross-sectional profile as shown in FIG. 2-(*b*) for Example 27 and in FIG. 2-(*c*) for Comparative Example 19. Table 4 shows the test results.

TABLE 4

| | Item | | | | | | | | | | | |
|---|---|---|---|---|---|---|---|---|---|---|---|---|
| Example | Resin Core/Sheath | Cross-sectional profile of fiber | Number of concavities | D/L Ratio | Thickness (dtex) | Fiber length (mm) | Type of functional agent | Pick up of functional agent (mass %) | Water content (mass %) | Number of Non-opened fiber bundles (per g) | Number of pills (per g) | Number of defects (per g) |
| Example 19 | PET/HDPE | (D) | 3 | 0.25 | 1.1 | 5 | Deodorant | 0.1 | 1.0 | 3 | 0 | 3 |
| 20 | PET/HDPE | (E) | 1 | 0.45 | 1.1 | 5 | Deodorant | 0.1 | 1.0 | 2 | 0 | 2 |
| 21 | PET/HDPE | (F) | 8 | 0.15 | 1.1 | 5 | Deodorant | 0.1 | 1.0 | 3 | 0 | 3 |
| Comparative Example 15 | PET/HDPE | (G) | 0 | — | 1.1 | 5 | Deodorant | 0.1 | 1.0 | 38 | 0 | 38 |
| Example 22 | PET/HDPE | (D) | 30 | 0.25 | 1.1 | 5 | Deodorant | 0.1 | 1.0 | 8 | 0 | 8 |
| 23 | PET/HDPE | (D) | 3 | 0.25 | 1.1 | 5 | Anti-bacterial | 0.25 | 5.0 | 2 | 0 | 2 |
| Comparative Example 16 | PET/HDPE | (G) | 0 | — | 1.1 | 5 | Anti-bacterial | 0.25 | 5.0 | >100 | 0 | >100 |
| Example 24 | PET/HDPE | (D) | 3 | 0.25 | 1.1 | 5 | Flame retardant | 1.0 | 10.0 | 8 | 0 | 8 |
| Comparative Example 17 | PET/HDPE | (G) | 0 | — | 1.1 | 5 | Flame retardant | 1.0 | 10.0 | >100 | 0 | >100 |
| Example 25 | PET/HDPE | (D) | 3 | 0.25 | 1.1 | 5 | Vermin-repellent | 0.5 | 5.0 | 4 | 0 | 4 |
| Comparative Example 18 | PET/HDPE | (G) | 0 | — | 1.1 | 5 | Vermin-repellent | 0.5 | 5.0 | >100 | 0 | >100 |
| Example 26 | PET | (A) | 3 | 0.30 | 1.0 | 5 | Deodorant | 0.1 | 1.0 | 3 | 0 | 3 |
| 27 | PET | (B) | 1 | 0.40 | 1.0 | 5 | Deodorant | 0.1 | 1.0 | 5 | 0 | 5 |
| Comparative Example 19 | PET | (C) | 0 | — | 1.0 | 5 | Deodorant | 0.1 | 1.0 | 41 | 0 | 41 |

INDUSTRIAL APPLICABILITY

The synthetic staple fibers of the present invention have the above-mentioned fiber length and irregular cross-sectional profile having a specific D/L ratio value. Due to these properties, the staple fibers of the present invention can form a uniform air-laid nonwoven fabric having reduced defects even under a high water-content condition under which the conventional staple fibers exhibit a degraded opening property and make it difficult to produce an air-laid nonwoven fabric having a high grade, and even when the staple fibers have a low thickness, a high degree of crimping, a low degree of crimping (including no crimp) and/or a high water content, and even when the staple fibers is formed from a high frictional resin. Accordingly, the synthetic staple fibers of the present invention greatly contributes to diversifying the constitution and function of air-laid nonwoven fabrics.

The invention claimed is:

1. Synthetic staple fibers for an air-laid nonwoven fabric, which staple fibers have a fiber length of 0.1 to 45 mm and a cross-sectioned profile having 1 to 30 concavities each satisfies the requirement: D/L=0.1 to 0.5, wherein D represents a largest distance between a tangent line drawn to a pair of convexities from which an opening of the concavity is defined, and a bottom of the concavity, measured in a direction at right angles to the tangent line, and L represents a distance between two points of contact of the pair of convexities with the tangent line.

2. The synthetic staple fibers for an air-laid nonwoven fabric as claimed in claim 1, having a water content of 0.6% by mass or more but not more than 10% by mass.

3. The synthetic staple fibers for an air-laid nonwoven fabric as claimed in claim 1, having a thickness of 5 dtex or less.

4. The synthetic staple fibers for an air-laid nonwoven fabric as claimed in claim 1, having a number of crimps of 0 to 5 crimps/25 mm or 15 to 40 crimps/25 mm.

5. The synthetic staple fibers for an air-laid nonwoven fabric as claimed in claim 1, wherein at least a portion of the peripheral surface of each staple fiber is formed from at least one member selected from the group consisting of polyester resins, polyamide resins, polypropylene resins, high pressure low density polyethylene resins, linear low density polyethylene resins and elastomer resins.

6. The synthetic staple fibers for an air-laid nonwoven fabric as claimed in claim 1, further comprising at least one functional agent adhered to the surfaces of the staple fibers, in an amount of 0.01 to 10% by mass on the basis of the mass of the staple fibers.

7. The synthetic staple fibers for an air-laid nonwoven fabric as claimed in claim 6, wherein the functional agent is selected from the group consisting of deodorant functional agents, antibacterial functional agents, flame retardant functional agents and vermin-repellent functional agents.

* * * * *